US009429878B2

(12) United States Patent
Ohashi et al.

(10) Patent No.: US 9,429,878 B2
(45) Date of Patent: Aug. 30, 2016

(54) IMAGE FORMING APPARATUS INCLUDING A TONER CONVEYANCE PORTION WITH VENT HOLES HAVING FILTERS DISPOSED THEREON

(71) Applicant: KYOCERA Document Solutions Inc., Osaka-shi, Osaka (JP)

(72) Inventors: Hiroaki Ohashi, Osaka (JP); Masahiro Kashimoto, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/810,304

(22) Filed: Jul. 27, 2015

(65) Prior Publication Data

US 2016/0026119 A1 Jan. 28, 2016

(30) Foreign Application Priority Data

Jul. 28, 2014 (JP) ..... 2014-153191

(51) Int. Cl.

| | |
|---|---|
| ***G03G 15/095*** | (2006.01) |
| ***G03G 15/08*** | (2006.01) |
| ***G03G 15/10*** | (2006.01) |
| ***G03G 21/00*** | (2006.01) |
| ***G03G 21/10*** | (2006.01) |
| ***G03G 21/12*** | (2006.01) |
| ***G03G 21/20*** | (2006.01) |

(52) U.S. Cl.

CPC ..... *G03G 15/095* (2013.01); *G03G 15/0844* (2013.01); *G03G 15/104* (2013.01); *G03G 21/0052* (2013.01); *G03G 21/10* (2013.01); *G03G 21/105* (2013.01); *G03G 21/12* (2013.01); *G03G 21/206* (2013.01); *G03G 2221/0089* (2013.01); *G03G 2221/1624* (2013.01)

(58) Field of Classification Search

CPC ..... G03G 15/095; G03G 15/0844; G03G 15/104; G03G 21/0052; G03G 21/10; G03G 21/105; G03G 21/12; G03G 21/206; G03G 2221/0089; G03G 2221/1624

See application file for complete search history.

(56) References Cited

U.S. PATENT DOCUMENTS

2011/0262174 A1* 10/2011 Gumbe ..... G03G 15/0898 399/92
2013/0183060 A1* 7/2013 Kang ..... G03G 21/20 399/92

FOREIGN PATENT DOCUMENTS

JP 2014025972 A 2/2014

* cited by examiner

*Primary Examiner* — Joseph S Wong

(74) *Attorney, Agent, or Firm* — Alleman Hall McCoy Russell & Tuttle LLP

(57) ABSTRACT

An image forming apparatus according to an aspect of the present disclosure includes a toner conveyance portion, a vent hole portion, an air suction portion, and a filter portion. The toner conveyance portion forms a toner conveyance passage between a developing device and a collection container such that toner discharged from the developing device is conveyed in the toner conveyance passage and collected in the collection container. The vent hole portion is formed in the toner conveyance portion and allows inside and outside of the toner conveyance portion to communicate with each other such that air can be ventilated between the inside and the outside of the toner conveyance portion. The air suction portion sucks the air inside the toner conveyance portion via the vent hole portion. The filter portion is disposed on the vent hole portion and traps toner contained in the air sucked by the air suction portion.

6 Claims, 8 Drawing Sheets

IMAGE FORMING APPARATUS INCLUDING A TONER CONVEYANCE PORTION WITH VENT HOLES HAVING FILTERS DISPOSED THEREON

INCORPORATION BY REFERENCE

This application is based upon and claims the benefit of priority from the corresponding Japanese Patent Application No. 2014-153191 filed on Jul. 28, 2014, the entire contents of which are incorporated herein by reference.

BACKGROUND

The present disclosure relates to an electrophotographic image forming apparatus that performs an image formation with use of toner.

In an image forming apparatus, generally, an electrostatic latent image formed on an image carrier such as a photoconductor drum is visualized by developer in a developing device, and the visualized image is transferred to a recording medium. At this time, some toner may not be transferred to the recording medium and remain on the surface of the photoconductor drum. The remnant toner is removed from the surface of the photoconductor drum by a cleaning device, and is collected, as waste toner, in a waste toner collection container. The waste toner is conveyed to a predetermined position by a screw in the horizontal direction parallel to the photoconductor drum. A conveyance duct is disposed at the predetermined position, and the waste toner is introduced into the conveyance duct and conveyed by another screw in the conveyance duct to the waste toner collection container.

Meanwhile, toner is likely to be scattered in the developing device. As a result, when an air pressure inside the developing device is higher than an air pressure outside thereof, tonner scattered inside the developing device may leak to the outside. When toner leaks to outside of the developing device, inside and outside of the image forming apparatus may be contaminated by the toner. To prevent this, conventionally, a suction nozzle is provided in the vicinity of the developing device such that scattered toner is sucked by a fan and trapped by a filter, thereby restricting the toner from being scattered in the peripheral of the developing device.

SUMMARY

An image forming apparatus according to an aspect of the present disclosure includes a toner conveyance portion, a vent hole portion, an air suction portion, and a filter portion. The toner conveyance portion forms a toner conveyance passage between a developing device and a collection container such that toner discharged from the developing device is conveyed in the toner conveyance passage and collected in the collection container. The vent hole portion is formed in the toner conveyance portion and allows inside and outside of the toner conveyance portion to communicate with each other such that air can be ventilated between the inside and the outside of the toner conveyance portion. The air suction portion is configured to suck the air inside the toner conveyance portion via the vent hole portion. The filter portion is disposed on the vent hole portion and configured to trap toner contained in the air sucked by the air suction portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the drawings. It should be noted that the following description is an example of a specific embodiment of the present disclosure and should not limit the technical scope of the disclosure.

Figure 1A:
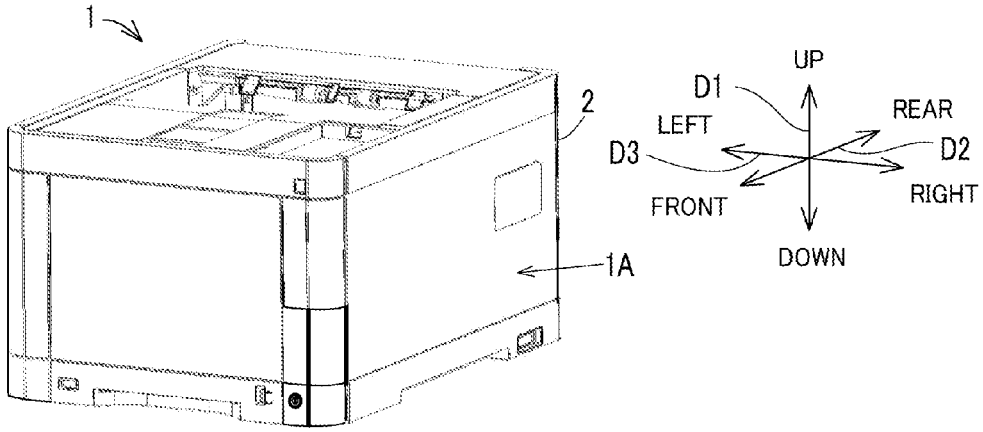
FIG. 1A is an outer appearance view of an image forming apparatus according to an embodiment of the present disclosure.

FIG. 1A is an outer appearance perspective view showing the configuration of an image forming apparatus 1 which is an embodiment of an image forming apparatus of the present disclosure. It is noted that the following description is given with use of an up-down direction D1, a front-rear direction D2, and a left-right direction D3 that are defined in FIG. 1A based on the normal use state of the image forming apparatus 1.

As shown in FIG. 1A, the image forming apparatus 1 is a printer. The image forming apparatus 1 prints an input image to a print sheet by using a print material such as toner. It is noted that the image forming apparatus 1 is not limited to a printer. Other examples of the image forming apparatus of the present disclosure include a facsimile, a copier, and a multifunction peripheral that has the functions of these.

The image forming apparatus 1 prints an image to a print sheet based on image data input from an external source via a network communication portion (not shown). As shown in FIG. 1A, the image forming apparatus 1 includes a housing 2 that includes a cover of an outer frame, and an inner frame.

Figure 1B:
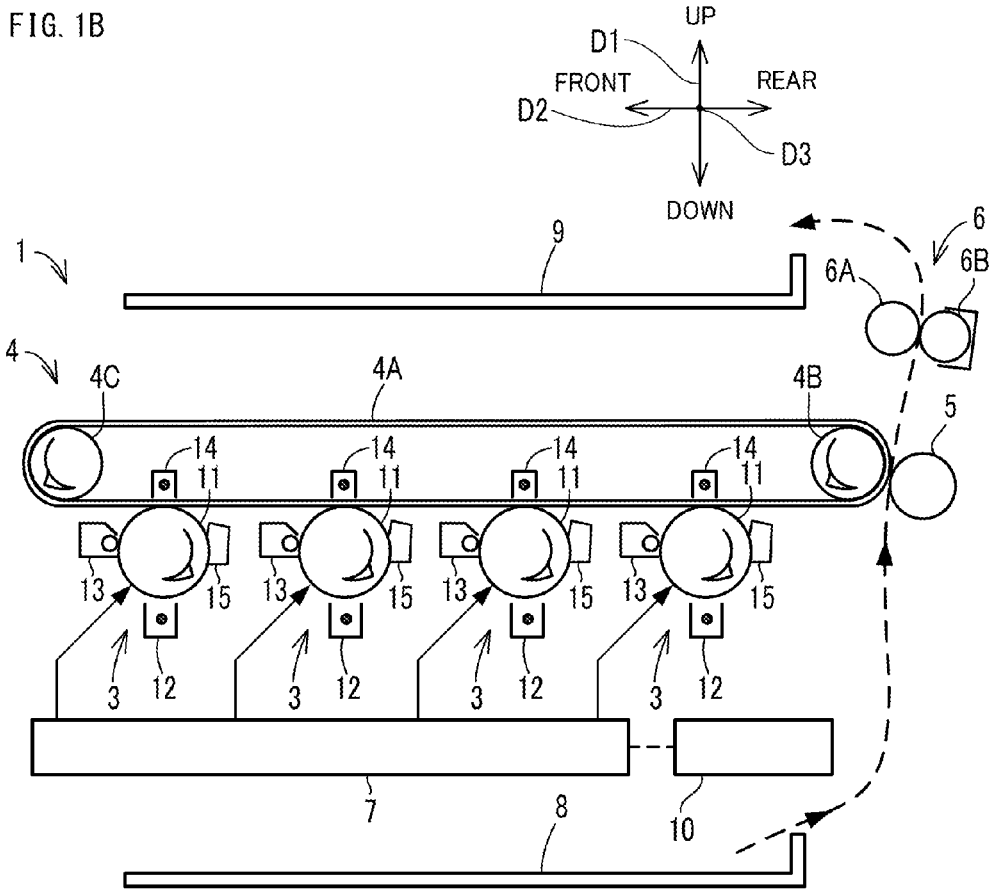
FIG. 1B is a schematic diagram showing the internal configuration of the image forming apparatus.

As shown in FIG. 1B, the image forming apparatus 1 is a so-called tandem color image forming apparatus and includes a plurality of image forming portions 3, an intermediate transfer unit 4, a secondary transfer device 5, a fixing device 6, an exposure device 7, a sheet feed portion 8, a sheet discharge portion 9, and a control portion 10.

The plurality of image forming portions 3 are arranged in alignment in the front-rear direction D2. The plurality of image forming portions 3 respectively form toner images of different colors. In FIG. 1B, an image forming portion 3 positioned on the most rear side forms a toner image by black toner, an image forming portion 3 positioned in front of it forms a toner image by yellow toner, an image forming portion 3 positioned in front of it forms a toner image by cyan toner, and an image forming portion 3 positioned on the most front side forms a toner image by magenta toner. Each of the image forming portions 3 includes a photoconductor drum 11, a charging device 12, a developing portion 13 (an example of the developing device of the present disclosure), a primary transfer device 14, and a cleaning portion 15. As a result, the image forming apparatus 1 includes a plurality of developing portions 13.

The intermediate transfer unit 4 includes an intermediate transfer belt 4A, a driving roller 4B, and a driven roller 4C. Supported by the driving roller 4B and the driven roller 4C so as to be rotationally driven, the intermediate transfer belt 4A can move (run) in the state where its surface is in contact with the surfaces of the photoconductor drums 11. When the intermediate transfer belt 4A passes through between the photoconductor drums 11 and the primary transfer devices 14, the toner images are transferred in sequence from the photoconductor drums 11 to a surface of the intermediate transfer belt 4A in such a way as to be overlaid with each other.

The secondary transfer device 5 transfers the toner image transferred on the intermediate transfer belt 4A, to a print sheet that is conveyed from the sheet feed portion 8. The print sheet with the toner image transferred thereon is conveyed to the fixing device 6. The fixing device 6 includes a heating roller 6A and a pressure roller 6B.

Figure 2:
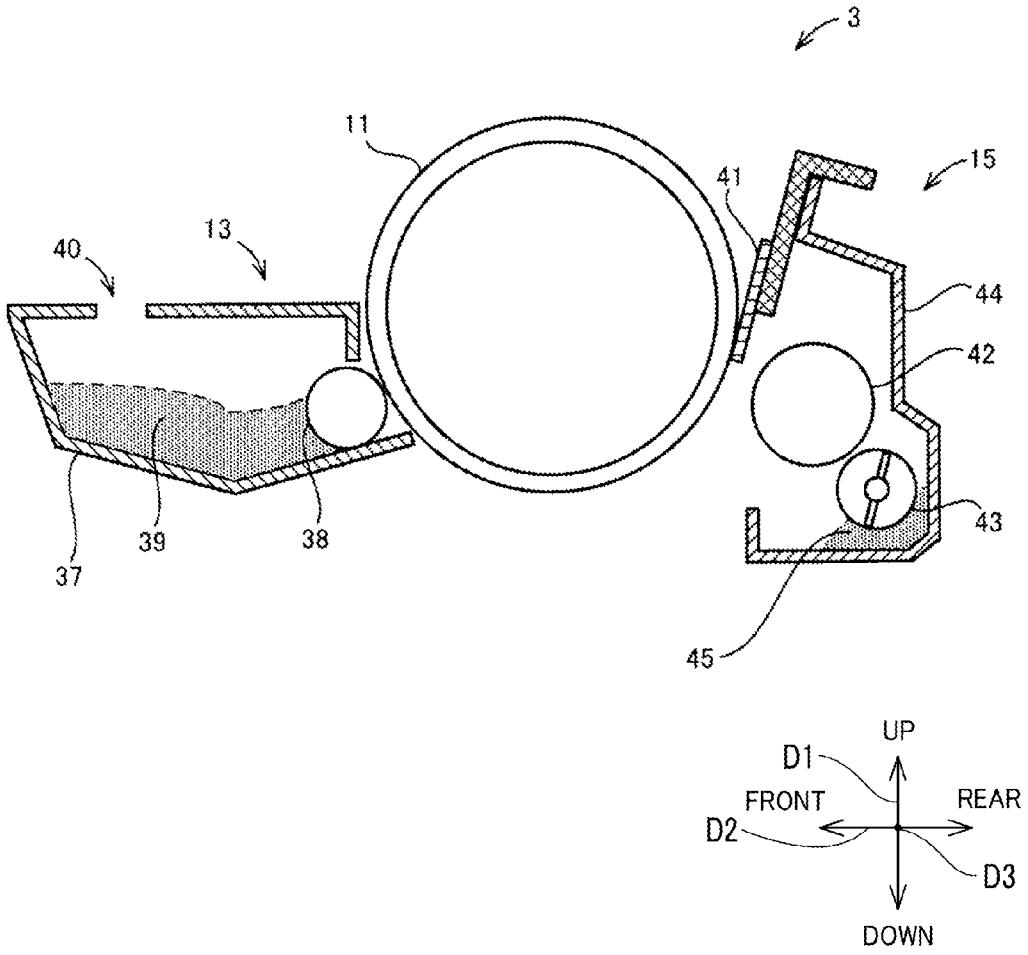
FIG. 2 is a schematic diagram showing the configuration of an image forming portion of the image forming apparatus.

FIG. 2 is a cross-sectional view schematically showing the photoconductor drum 11, the developing portion 13, and the cleaning portion 15 in an image forming portion 3.

Each developing portion 13 includes a developing case 37. A magnet roller 38 for developing is provided in the developing case 37. A bias having the same polarity as the charging polarity of the photoconductor drum 11 is applied to the magnet roller 38. Toner 39 is electrically charged by the magnet roller 38, and the charged toner 39 is flown onto an electrostatic latent image on the surface of the photoconductor drum 11 so as to develop the electrostatic latent image. The toner 39 is supplied from a toner container (not shown) via a toner supply port 40.

The cleaning unit 15 includes a cleaning blade 41, a cleaning roller 42, a first screw member 43, and a toner box 44, wherein the cleaning blade 41 is a cleaning member. The cleaning blade 41 and the cleaning roller 42 have approximately the same length as the photoconductor drum 11, and are configured to contact the photoconductor drum 11 and remove the residual waste toner from the surface of the photoconductor drum 11. The removed waste toner is taken into the toner box 44 by the action of gravity or by the rotation of the cleaning roller 42. Waste toner 45 taken into the toner box 44 is conveyed by the first screw member 43. A discharge port (not shown) is formed in the right side wall of the toner box 44. The first screw member 43 has a helical blade around a shaft body. The waste toner conveyed by the first screw member 43 is conveyed to the discharge port.

Figure 3:
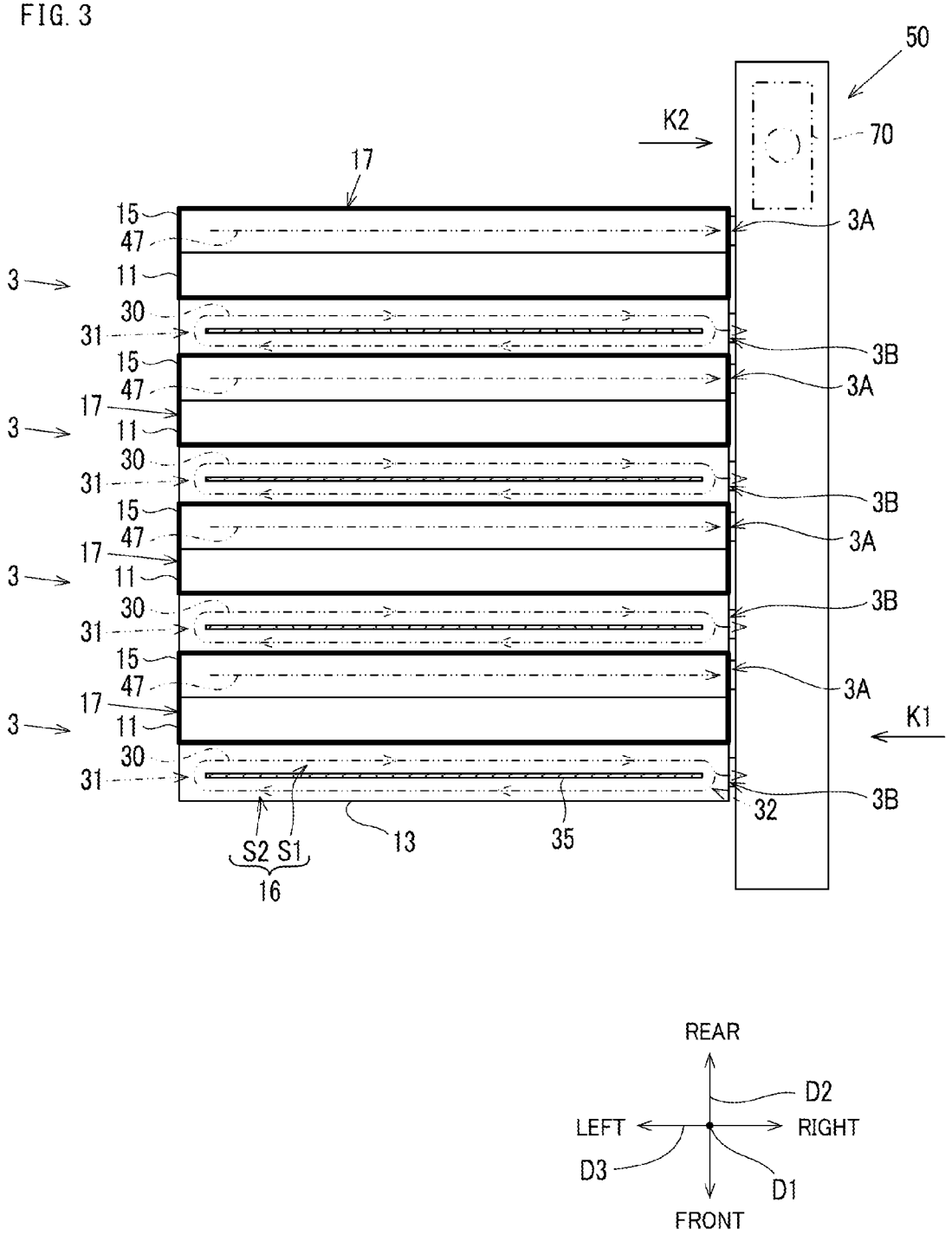
FIG. 3 is a diagram for explaining flow paths respectively provided in the image forming portions, wherein toner and the like removed from photoconductor drums by cleaning members flow in the flow paths until they are collected in a collection container.

Each pair of the photoconductor drum 11 and the cleaning portion 15 is unitized as a drum unit 17 (see FIG. 3). A plurality of discharge ports 3A are formed in end portions of housings (not shown) of the drum units 17. The discharge ports 3A respectively communicate with the discharge ports that are formed in the right side walls of the toner boxes 44.

FIG. 3 is a diagram for explaining flow paths in the image forming portions 3, wherein toner and the like removed from the photoconductor drums 11 by the cleaning blades 41 and the cleaning rollers 42 flow in the flow paths until they are collected in a collection container 70 that is described below. As shown in FIG. 3, the toner removed by the cleaning members is conveyed as waste toner from left to right in conveyance paths 47 that extend in the left-right direction D3 in the image forming apparatus 1. The waste toner that has flown to the right end of the image forming portions 3 is discharged from the discharge ports 3A provided at the right end of the drum units 17, to a storage portion 50 that is described below.

Each developing portion 13 visualizes, with developer, an electrostatic latent image formed on the surface of the photoconductor drum 11. As the developer, a two-component developer composed of toner and carrier is used. The toner is made of resin and the carrier is made of a magnetic material. Toner is smaller than carrier in particle size. As a result, toner is smaller than carrier in weight. In addition, an external additive is added to the developer. The external additive is, for example, a metal oxide such as silica, titanium oxide, alumina, or magnesium oxide. With the presence of the external additive, fluidity of toner is improved, toner is charged properly, or the performance of removing toner from the photoconductor drum 11 is improved. The carrier is magnetic particles composed of ferrite and the like. When a mixture of carrier and toner is stirred, toner is charged with static electricity that is generated by the friction between the toner and the carrier. With the presence of carrier, the two-component developer allows toner to be more easily charged than the one-component developer that is composed of only toner, thereby a high-quality image is made possible.

Among toner and carrier that compose the two-component developer, the toner is consumed in the image formation process. As a result, toner is supplied to the developing portions 13 from a tank (not shown) to supplement the consumed amount of toner. On the other hand, the carrier remains in the developing portions 13 without being consumed, and gives fluidity and the like to the toner that is newly supplied to the developing portions 13. In this way, carrier is used for a longer period than toner. When carrier is used for a long period and stirred many times, the resin coat layer formed on the surface of carrier particles may peel off, or toner particles may stick to the surface of carrier particles. Due to such phenomena, carrier is deteriorated and its performance of giving the fluidity or the like is degraded.

In addition, although not shown, each developing portion 13 stirs the two-component developer by a second screw member (not shown) so as to charge toner sufficiently. The second screw member includes a helical blade around the shaft body. When the two-component developer remains in the developing portions 13 for a long period, toner particles change in shape and size due to friction between toner particles caused by the stirring operation in the developing portions 13, and toner is deteriorated since the charging characteristic of toner changes. When an image is formed using such deteriorated toner, the charged amount of toner is reduced and fogging of toner or the like is likely to occur, which leads to degradation of image quality.

In the present embodiment, to avoid such a problem, a developing device of a so-called trickle development system is adopted, wherein in the trickle development system, old two-component developer is gradually discarded, and new two-component developer is gradually supplied. Hereinafter, the two-component developer that is discarded as such is referred to as waste developer. As described below, the waste developer is collected in the collection container 70 together with the waste toner that has been removed from the surface of the photoconductor drums 11.

Each developing portion 13 of the trickle development system includes a developer storage portion 16 for storing the two-component developer. The developer storage portion 16 includes a partition wall 35 that is erected on a bottom surface (not shown) thereof along the longitudinal direction of the developing portion 13. The inner space of the developer storage portion 16 is partitioned into two spaces S1 and S2 by the partition wall 35. The two spaces S1 and S2 are communicated with each other at opposite ends of the developer storage portion 16 in the left-right direction D3 (see arrows 31 and 32). In addition, the second screw member (not shown) is provided in each of the two spaces S1 and S2. With the rotation of these second screw members, a circulation path 30 in which the two-component developer circulates in the spaces S1 and S2 of the developer storage portion 16 is formed.

In the right end portions of the developing cases 37 of the developing portions 13, a plurality of discharge port portions 3B (see FIG. 3) are provided such that the two-component developer is discharged from the developing portions 13 to the storage portion 50 that is described below. Part of the circulating two-component developer is discharged to the storage portion 50 from the discharge port portions 3B as the waste developer.

Figure 4:
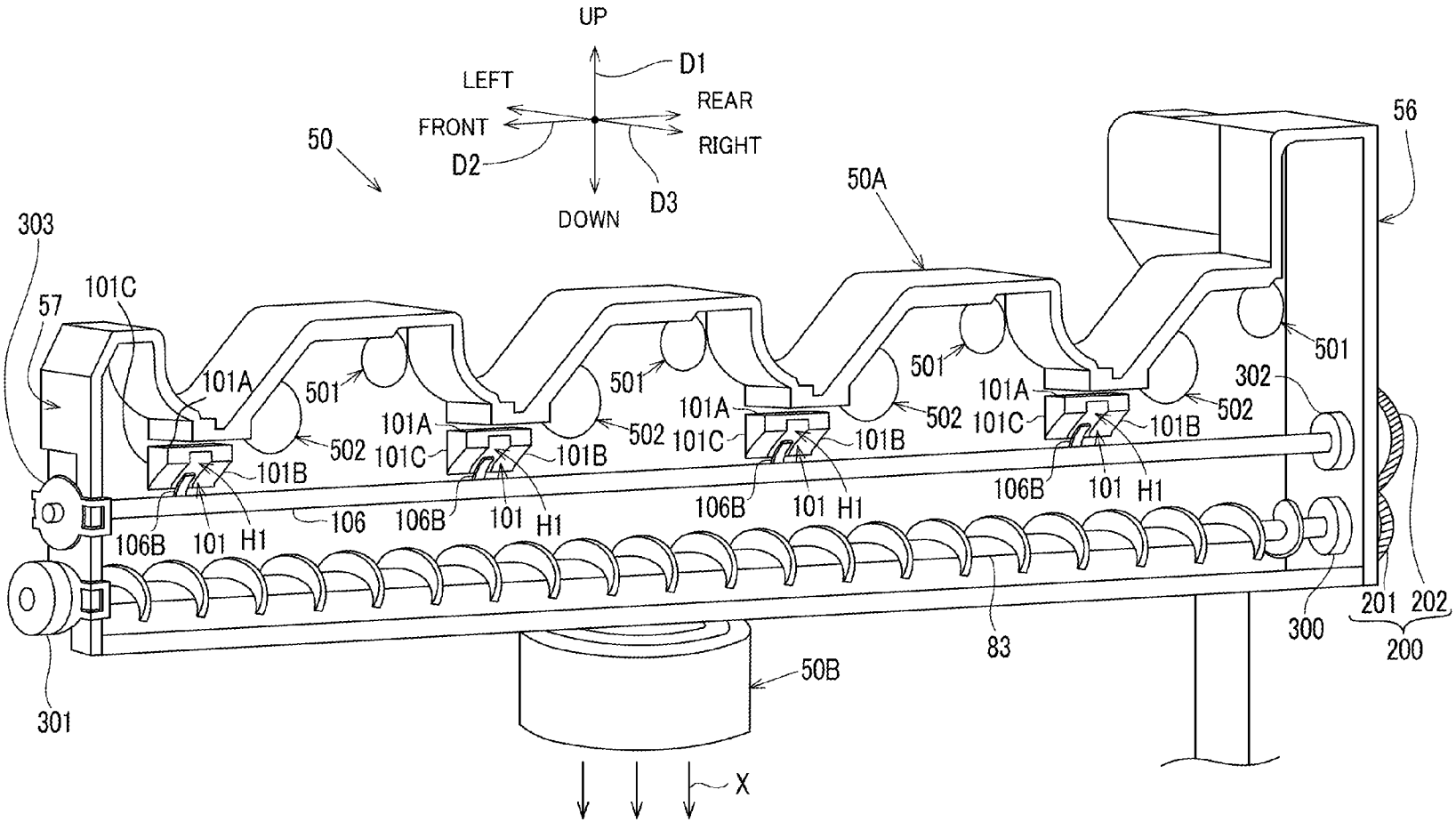
FIG. 4 is a diagram showing the internal configuration of a storage portion.
Figure 5:
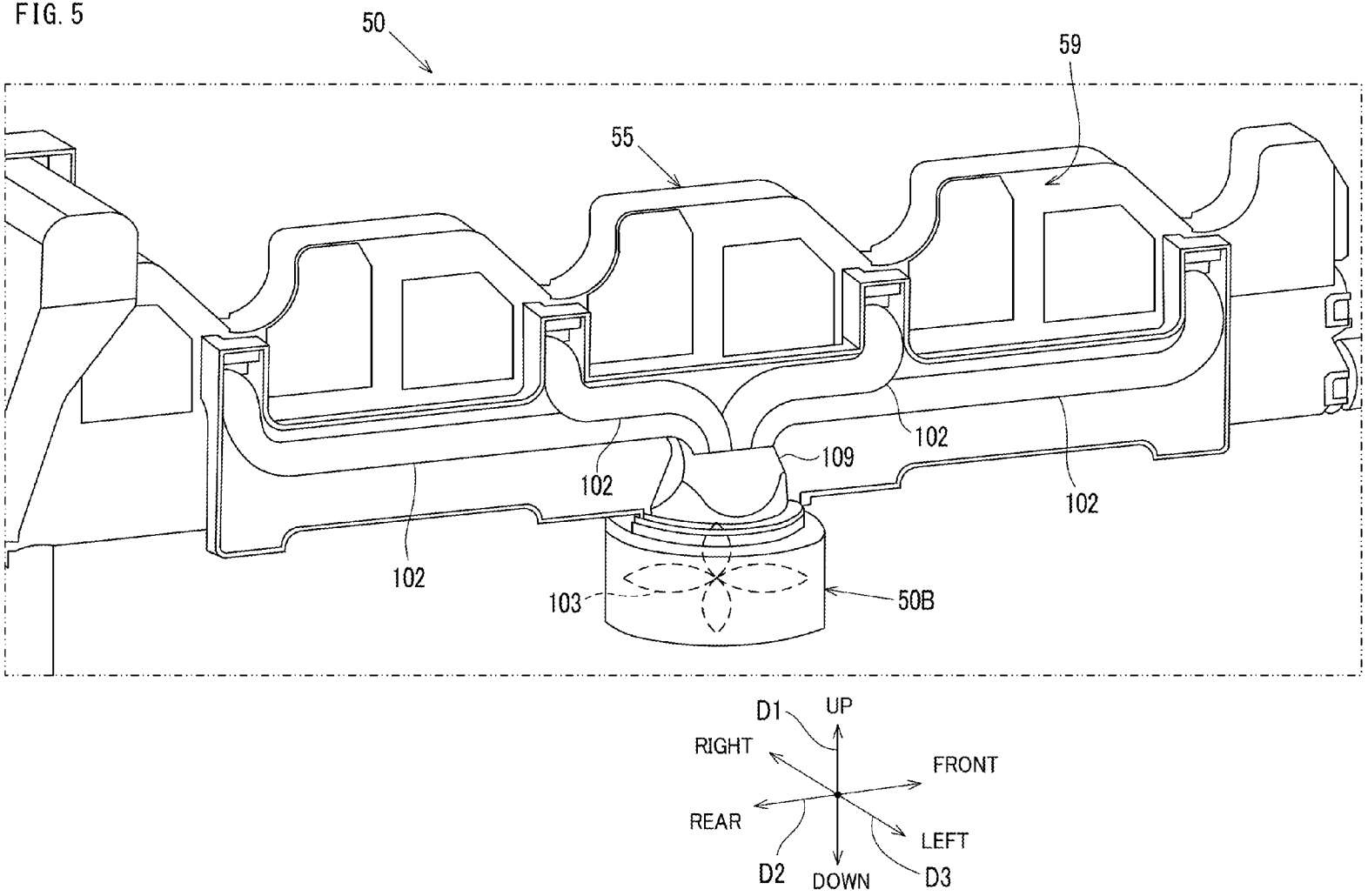
FIG. 5 is an outer appearance perspective view of the storage portion.

FIG. 4 is a diagram viewed from the arrow K1 of FIG. 3 and showing the internal configuration of the storage portion 50 that is described below. FIG. 5 is an outer appearance perspective view of the storage portion 50 viewed from the arrow K2 of FIG. 3. As shown in FIG. 3 and FIG. 4, the image forming apparatus 1 includes the storage portion 50. As shown in FIG. 4, the storage portion 50 includes an accumulation portion 50A and a fan storage portion 50B formed below the accumulation portion 50A, wherein the waste toner and the waste developer are accumulated in the accumulation portion 50A.

The accumulation portion 50A includes a wall portion 55 (see FIG. 4, FIG. 5) that faces the end portions of one side of the image forming portions 3. The wall portion 55 includes introduction port portions 501 and introduction port portions 502, wherein the introduction port portions 501 communicate with the discharge ports 3A, and the introduction port portions 502 communicate with the discharge port portions 3B, respectively. A plurality of introduction port portions 501 are provided in correspondence with the plurality of discharge ports 3A. A plurality of introduction port portions 502 are provided in correspondence with the plurality of discharge port portions 3B. Waste toner that has reached the discharge ports 3A is introduced, and falls, from the corresponding introduction port portions 501 into the accumulation portion 50A. In addition, waste developer that has reached the discharge port portions 3B is introduced, and falls, from the corresponding introduction port portions 502 into the accumulation portion 50A. In this way, the accumulation portion 50A temporarily stores waste toner and waste developer that have been discharged from the cleaning portions 15 and the developing portions 13 of the image forming portions 3.

A screw member 83 is provided inside the accumulation portion 50A. Specifically, the accumulation portion 50A includes a wall portion 56 and a wall portion 57, wherein the wall portion 56 intersects with the rear-side edge of the wall portion 55, and the wall portion 57 intersects with the front-side edge of the wall portion 55. The screw member 83 is rotatably supported by a bearing 300 provided on the wall portion 56 and a bearing 301 provided on the wall portion 57 in the state where the screw member 83 is passed through and suspended by the wall portion 56 and the wall portion 57. The screw member 83 is rotationally driven by a drive motor (not shown). The accumulation portion 50A is connected with the collection container 70. The waste toner and the waste developer accumulated in the accumulation portion 50A are conveyed to the collection container 70 (see FIG. 3, FIG. 7) as the screw member 83 rotates, and are collected in the collection container 70. The accumulation portion 50A forms a toner conveyance passage between the developing portions 13 and the collection container 70 that collects the toner discharged from the developing portions 13. The accumulation portion 50A of the storage portion 50 is an example of the toner conveyance portion of the present disclosure, and the screw member 83 is an example of the conveyance member of the present disclosure. The fan storage portion 50B is described below.

Meanwhile, toner in the developing portions 13 is likely to be scattered. As a result, when an air pressure inside the developing portions 13 is higher than an air pressure outside thereof, tonner scattered inside the developing portions 13 may leak to the outside. When toner leaks to outside of the developing portions 13, inside and outside of the image forming apparatus 1 may be contaminated by the toner. To prevent this, conventionally, a suction nozzle is provided in the vicinity of the developing portions 13 such that scattered toner is sucked by a fan and trapped by a filter, thereby restricting the toner from being scattered in the peripheral of the developing portions 13.

However, according to the conventional configuration, a dedicated collection box for collecting the trapped toner is required. The provision of the dedicated collection box increases the number of components and increases the size of the apparatus. In addition, the provision of the dedicated collection box leads to increase of manufacturing cost of the apparatus.

In view of the above-described problems, the image forming apparatus 1 of the present embodiment is provided with a trapping mechanism 100 for trapping the scattered toner in the developing portions 13 by using the configuration where the inner spaces of the developing portions 13 are communicated with the inner space of the storage portion 50 via the discharge port portions 3B and the introduction port portions 502, wherein the trapping mechanism 100 is described below.

As shown in FIG. 4 to FIG. 7, the trapping mechanism 100 includes vent hole portions 101, vent passage portions 102, an air suction portion 103, and a trapping portion 104.

The vent hole portions 101 are formed in the wall portion 55 of the accumulation portion 50A in such a way as to pass through the wall portion 55 to the vent passage portions 102 side. In the present embodiment, the vent hole portions 101 are formed in the vicinity of the introduction port portions 502. With this configuration, if the waste toner among the waste developer introduced from the introduction port portions 502 into the accumulation portion 50A, is scattered, the scattered toner is trapped before it is scattered over the whole accumulation portion 50A. In addition, a plurality of vent hole portions 101 are provided in correspondence with the plurality of introduction port portions 502.

Figure 6:
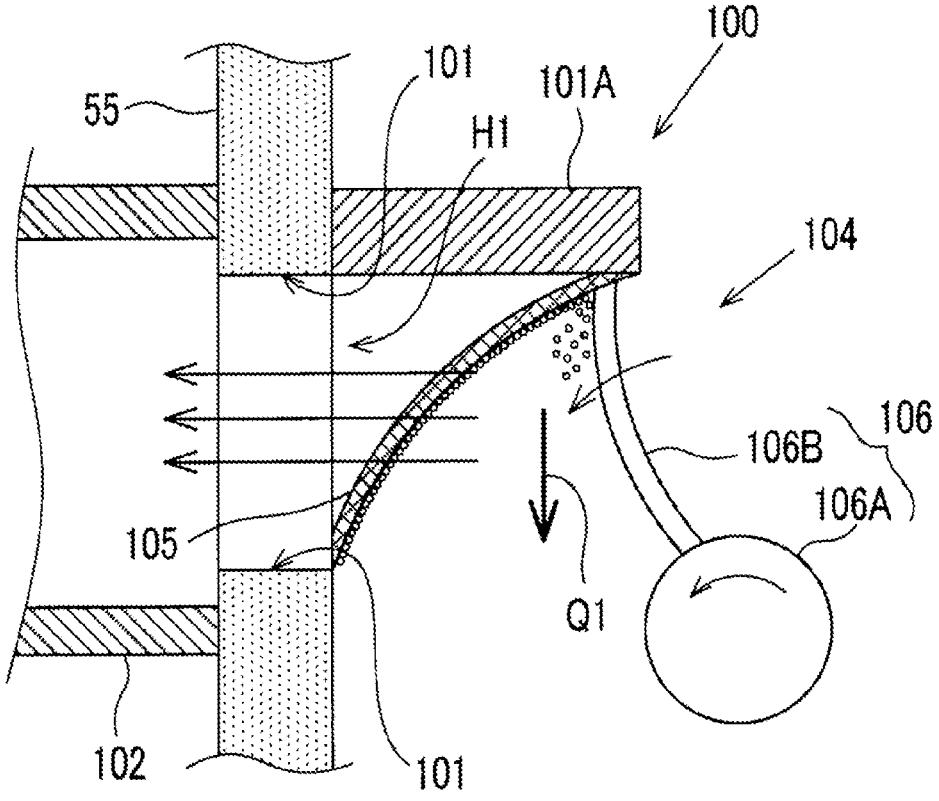
FIG. 6 is an enlarged cross-sectional view of a vent hole portion.

At an end part of each vent hole portion 101, an eaves portion 101A, a side wall portion 101B, and a side wall portion 101C are provided. As shown in FIG. 4 and FIG. 6, the eaves portion 101A projects from the upper end part of the vent hole portion 101 toward the inside of the accumulation portion 50A (the right side in FIG. 4). The side wall portion 101B and the side wall portion 101C are provided respectively at end parts of both sides of each vent hole portion 101. A vent hole H1 is formed such that its top and sides are surrounded by the eaves portion 101A, the side wall portion 101B, and the side wall portion 101C. With this configuration, part of the scattered toner that has entered the storage portion 50 via the introduction port portions 502 collides with the eaves portion 101A, the side wall portion 101B, and the side wall portion 101C and falls, and the remaining scattered toner reaches the vent hole H1 by going around the eaves portion 101A, the side wall portion 101B, and the side wall portion 101C.

As shown in FIG. 5, the vent passage portions 102 are formed on an outer wall surface 59 of the wall portion 55 of the accumulation portion 50A. In the present embodiment, the vent passage portions 102 are each formed in the shape of a pipe, and are formed in correspondence with the vent hole portions 101. Ends of the inner spaces of the vent passage portions 102 on one side are respectively communicated with the vent holes H1, and ends of the inner spaces of the vent passage portions 102 on the other side merge at a merge portion 109, and the inner space of the merge portion 109 is communicated with the inner space of the fan storage portion 50B. In this way, the vent hole portions 101 allow inside and outside of the accumulation portion 50A to communicate with each other such that air can be ventilated between the inside and the outside of the accumulation portion 50A. The vent hole portions 101 are an example of the vent hole portion of the present disclosure.

The air suction portion 103 is, for example, an axial fan. The fan storage portion 50B is in the shape of a cylinder with no bottom, and the air suction portion 103 is stored in the fan storage portion 50B. The air suction portion 103 exhausts air to outside of the fan storage portion 50B (see arrows X in FIG. 4). In this way, the air suction portion 103 sucks the air inside the accumulation portion 50A via the vent hole portions 101. The air suction portion 103 is an example of the air suction portion of the present disclosure.

The trapping portion 104 includes filter portions 105 and toner removing members 106 (an example of the toner removing portion of the present disclosure). The filter portions 105 are respectively provided on the vent hole portions 101. The filter portions 105 are provided in such a way as to cover the vent holes H1 formed in the vent hole portions 101, from the inner side. Specifically, as shown in FIG. 6, each filter portion 105 is attached to the eaves portion 101A, the side wall portion 101B, and the side wall portion 101C so as to cover an opening from a tip part (projection end) of the eaves portion 101A to a lower end part of each vent hole portion 101. The filter portions 105 have a mesh whose size is smaller than scattered toner particles such that the scattered toner particles cannot pass therethrough. In this way, the filter portions 105 trap the scattered toner contained in the air sucked by the air suction portion 103. The filter portions 105 correspond to the filter portion of the present disclosure.

As shown in FIG. 6, the toner removing member 106 is configured to remove, from the filter portions 105, the scattered toner that has been trapped by the filter portions 105. Specifically, the toner removing member 106 includes a shaft portion 106A and a scraping paddle portion 106B. As shown in FIG. 4, similar to the screw member 83, the toner removing member 106 is rotatably supported by a bearing 302 and a bearing 303 in the state where the toner removing member 106 is passed through and suspended by the wall portion 56 and the wall portion 57. The toner removing member 106 is installed in the accumulation portion 50A such that the shaft portion 106A is parallel to the screw member 83.

As shown in FIG. 4, the image forming apparatus 1 includes a drive transmission mechanism 200. The drive transmission mechanism 200 includes a gear 201 and a gear 202. The gear 201 is provided on the same axis as the screw member 83 and is attached to one end of the screw member 83 that has been passed through the wall portion 56 of the accumulation portion 50A to the outside. The gear 202 is provided on the same axis as the toner removing member 106 and is attached to one end of the shaft portion 106A that has been passed through the wall portion 56 of the accumulation portion 50A to the outside. The gear 201 and the gear 202 mesh with each other. The gear 201 provided on the screw member 83 is rotated together with the screw member 83 by a driving force of the drive motor that rotationally drives the screw member 83. As a result, the driving force of the drive motor is transmitted to the gear 202 provided on the toner removing member 106 by the gear 201. This allows the toner removing member 106 to rotate around the axis. In this way, the drive transmission mechanism 200 transmits the driving force input from the drive motor rotationally driving the screw member 83, to the shaft portion and causes the scraping paddle portion 106B to rotate together with the shaft portion 106A.

As shown in FIG. 6, the scraping paddle portion 106B is provided on the shaft portion 106A at a position facing the vent hole portions 101. The scraping paddle portion 106B extends from the circumferential surface of the shaft portion 106A in a direction of intersecting with the axis of the shaft portion 106A, and is made of a material that has an elastic force. The scraping paddle portion 106B is configured such that its tip part contacts the filter portions 105 when the rotation position of the shaft portion 106A is within a predetermined position range. When the tip part of the scraping paddle portion 106B contacts the filter portions 105, the scraping paddle portion 106B scrapes off the waste toner that has stuck to the filter portions 105. The waste toner scraped off from the filter portions 105 by the toner removing member 106 falls (see the arrow Q1 in FIG. 6). As a result, the waste toner that has been trapped by the filter portions 105 is also conveyed to the collection container 70 by the screw member 83, and is collected in the collection container 70.

Figure 7:
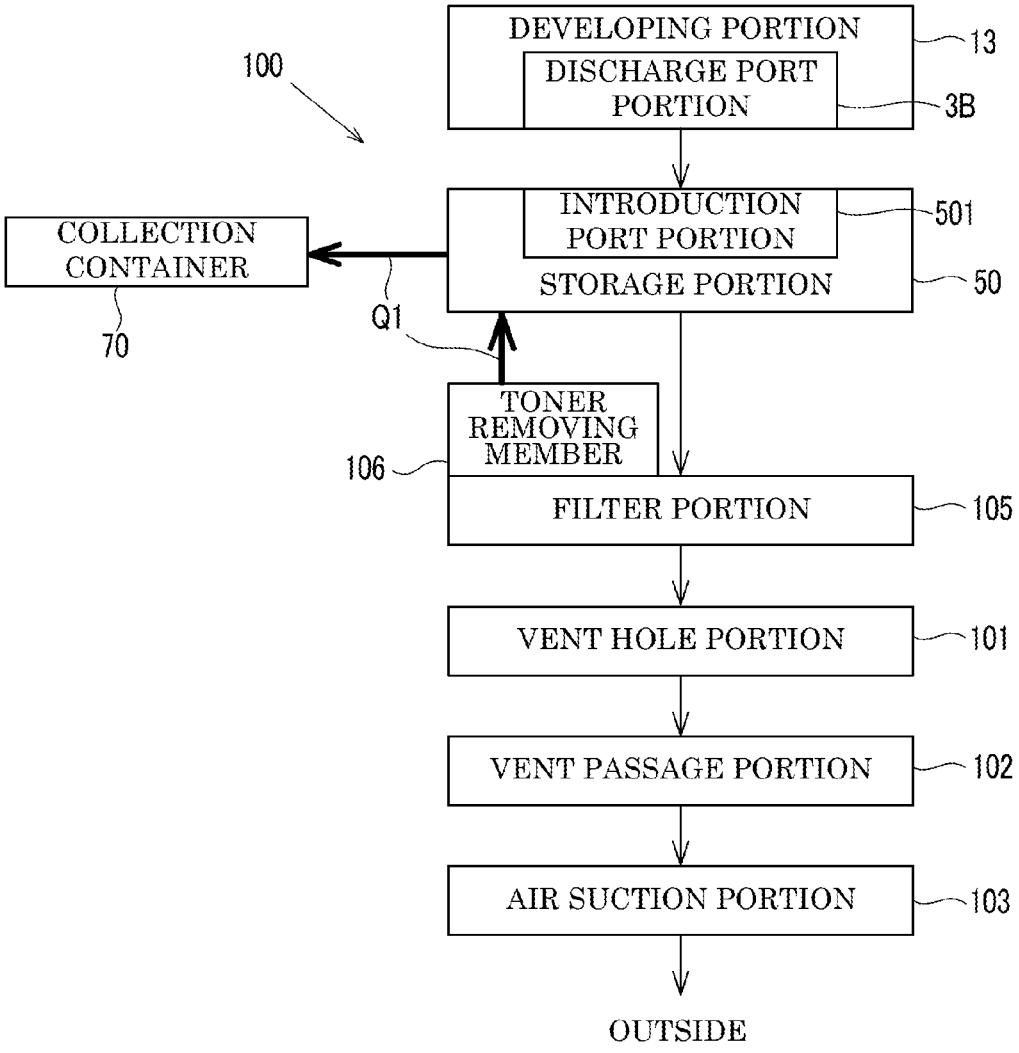
FIG. 7 is a diagram showing how air flows when a fan is operated.

In the trapping mechanism 100 having the above-described configuration, as shown in FIG. 7, when the air suction portion 103 is activated, the air inside the accumulation portion 50A is sucked via the vent passage portions 102 and the vent hole portions 101. Furthermore, since the inner space of the storage portion 50 is communicated with the inner spaces of the developing portions 13 via the introduction port portions 502 and the discharge port portions 3B, the air inside the developing portions 13 is sucked.

As a result, the air and the scattered toner inside the developing portions 13 are introduced into the accumulation portion 50A of the storage portion 50 via the discharge port portions 3B and the introduction port portions 502, and further flow toward the vent hole portions 101. Here, the air passes through the filter portions 105 of the trapping portion 104 and the vent holes H1, is introduced into the inner space of the fan storage portion 50B by passing through the vent passage portions 102 and the merge portion 109, and is discharged to outside by the air suction portion 103. On the other hand, the scattered toner that flows toward the vent hole portions 101 by going around each eaves portion 101A, side wall portion 101B, and side wall portion 101C, is dammed by the filter portions 105, and sticks to the filter portions 105 or collides with the filter portions 105 and then naturally falls. The toner that has stuck to the filter portions 105 is scraped off by the scraping paddle portion 106B and falls. The fallen toner is conveyed to the collection container 70 by the screw member 83 together with the waste toner and the waste developer accumulated in the accumulation portion 50A, and is collected in the collection container 70.

The above-described configuration makes it possible to trap toner that has been scattered in the developing portions 13, and prevent the toner from being scattered in the peripheral of the developing portions 13. In addition, compared to the case where a dedicated box is provided to collect the trapped toner, the above-described configuration can prevent increase in the number of components and the size of the image forming apparatus, and prevent increase of the cost.

Figure 8:
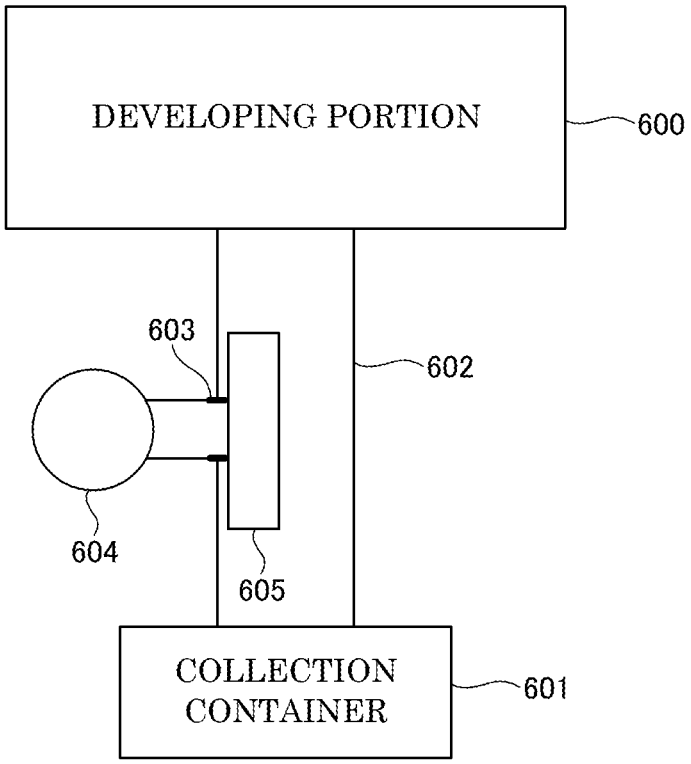
FIG. 8 is a diagram showing an idea of the present disclosure.

In the above-described embodiment, the present disclosure is applied to the configuration where the storage portion 50 is provided between the developing portions 13 and the collection container 70 and the storage portion 50 forms the toner conveyance portion. However, the application target of the present disclosure is not limited to the configuration including the storage portion 50, but may be any configuration that, as shown in FIG. 8, includes a toner conveyance portion 602 forming a toner conveyance passage between a developing portion 600 and a collection container 601.

That is, the essence of the image forming apparatus of the present disclosure is to include the toner conveyance portion 602, a vent hole portion 603, an air suction portion 604, and a filter portion 605. The vent hole portion 603 is formed in the toner conveyance portion 602 and allows inside and outside of the toner conveyance portion to communicate with each other such that air can be ventilated between the inside and the outside of the toner conveyance portion. The air suction portion 604 sucks the air inside the toner conveyance portion 602 via the vent hole portion 603. The filter portion 605 is provided on the vent hole portion 603 and traps the toner included in the air sucked by the air suction portion 604.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a toner conveyance portion forming a toner conveyance passage between at least one developing device and a collection container such that toner discharged from the developing device is conveyed in the toner conveyance passage and collected in the collection container;

at least one vent hole portion formed in the toner conveyance portion and allowing inside and outside of the toner conveyance portion to communicate with each other such that air can be ventilated between the inside and the outside of the toner conveyance portion;

an air suction portion configured to suck the air inside the toner conveyance portion via the vent hole portion;

a filter portion disposed on the vent hole portion and configured to trap toner contained in the air sucked by the air suction portion; and a toner removing portion configured to remove, from the filter portion, the toner that has been trapped by the filter portion, wherein the toner removing portion includes a shaft portion and a paddle portion, the shaft portion being disposed inside the toner conveyance portion, the paddle portion extending from the shaft portion and configured to contact the filter portion with a rotation of the shaft portion around an axis thereof.

2. The image forming apparatus according to claim 1, wherein the paddle portion has an elastic force.

3. The image forming apparatus according to claim 1, wherein the filter portion is attached in such a way as to be in a shape of an arc whose center is the shaft portion.

4. The image forming apparatus according to claim 1, wherein the at least one developing device is a plurality of developing devices, and the image forming apparatus further comprises:

a plurality of introduction port portions formed in the toner conveyance portion and configured to introduce toner discharged from the plurality of developing devices into the toner conveyance portion;

a storage portion disposed in the toner conveyance portion and configured to store the toner introduced from the plurality of introduction port portions and guide the toner to the collection container;

a conveyance member disposed in the storage portion and configured to receive a driving force input from a predetermined driving source and convey the toner stored in the storage portion to the collection container; and a drive transmission mechanism configured to transmit the driving force to the shaft portion so as to cause the shaft portion to rotate together with the paddle portion.

5. The image forming apparatus according to claim 4, wherein the conveyance member is rotatably supported by the storage portion, and the toner removing portion is disposed above the conveyance member in parallel to a rotation axis of the conveyance member.

6. The image forming apparatus according to claim 4, wherein the at least one vent hole portion is a plurality of vent hole portions that respectively correspond to the plurality of introduction port portions.

* * * * *